US010327081B2

(12) United States Patent
Henry

(10) Patent No.: US 10,327,081 B2
(45) Date of Patent: Jun. 18, 2019

(54) ANNOUNCEMENT SYSTEM WITH SPEAKERS ATTACHED

(71) Applicant: Kevin Craig Henry, Brazoria, TX (US)

(72) Inventor: Kevin Craig Henry, Brazoria, TX (US)

( * ) Notice: Subject to any disclaimer, the term of this patent is extended or adjusted under 35 U.S.C. 154(b) by 0 days.

(21) Appl. No.: 15/424,783

(22) Filed: Feb. 4, 2017

(65) Prior Publication Data

US 2018/0132047 A1 May 10, 2018

Related U.S. Application Data

(60) Provisional application No. 62/291,438, filed on Feb. 4, 2016.

(51) Int. Cl.

| | |
|---|---|
| ***H04R 27/00*** | (2006.01) |
| ***H04R 5/02*** | (2006.01) |
| ***B66F 9/065*** | (2006.01) |
| ***H04R 1/02*** | (2006.01) |
| ***B66C 23/36*** | (2006.01) |

(52) U.S. Cl.

CPC ..... *H04R 27/00* (2013.01); *B66C 23/36* (2013.01); *B66F 9/0655* (2013.01); *H04R 1/021* (2013.01); *H04R 5/02* (2013.01); *H04R 1/026* (2013.01); *H04R 2499/13* (2013.01)

(58) Field of Classification Search

None

See application file for complete search history.

(56) References Cited

U.S. PATENT DOCUMENTS

| | | | | |
|---|---|---|---|---|
| 8,087,342 | B1 * | 1/2012 | Hall | F41H 7/00 180/9.5 |
| 2002/0000731 | A1 * | 1/2002 | Wieczorek | G08B 7/06 296/24.31 |
| 2011/0112988 | A1 * | 5/2011 | Baker | G06Q 99/00 705/500 |
| 2012/0288134 | A1 * | 11/2012 | Newberg | H04R 1/025 381/387 |
| 2013/0333302 | A1 * | 12/2013 | Valente | E04H 3/123 52/7 |

(Continued)

*Primary Examiner* — Qin Zhu

(74) *Attorney, Agent, or Firm* — Karen B. Tripp

(57) ABSTRACT

A mobile entertainment and announcement system has a trailer base and a trailer body mounted on the trailer base. A trailer hitch projecting from a forward end of the trailer base allows the mobile entertainment and announcement system to be transported to a desired venue by connecting the trailer hitch to a vehicle. A telescoping boom is supported by at least one of the trailer base and the trailer body, and is adapted to move from a transport position to a set-up position and to a broadcast position. At least one broadcast speaker is mounted on the telescoping boom when the telescoping boom is in a set-up position, so that when the telescoping boom is moved from the transport position to the broadcast position, the broadcast speaker is moved to a higher elevation above the trailer base. An audio component housed in the trailer body is connected to the broadcast speaker for transmitting audio content to an audience over a larger area. A power supply is used to provide power to the broadcast speaker and the audio component, while also providing protection to at least one of the audio component and the power supply.

12 Claims, 3 Drawing Sheets

(56) References Cited

U.S. PATENT DOCUMENTS

2014/0335897 A1* 11/2014 Clem ..... G08G 1/0112
455/456.3
2016/0059794 A1* 3/2016 Brown ..... B60R 11/0217
224/404

* cited by examiner

ANNOUNCEMENT SYSTEM WITH SPEAKERS ATTACHED

RELATED APPLICATION

This application claims priority from U.S. Provisional Patent Application No. 62/291,438 filed Feb. 4, 2016.

FIELD OF THE INVENTION

The present invention relates to mobile entertainment and announcement systems, and in particular, to entertainment and announcement systems transportable by trailer.

BACKGROUND OF THE INVENTION

Many events are enhanced by music, broadcasting and other audio projections. Such events include parties, weddings, sporting events, company picnics, election campaigning, and the like. And in the case of, for example, emergencies and disasters, there is often a need for broadcasting announcements over a wide area. Often the location of these events is outdoors, for example, on a beach, at a golf course, church grounds, fair grounds, parking lots, parks, fields, disaster areas, and the like, where audio systems are not readily available.

Portable boom boxes, and microphones have been used, but the reach and quality of the audio projection is limited. There is a need for a mobile entertainment and announcement system that can be transported to a variety of outdoor venues where audio projection is required.

U.S. Pat. No. 8,269,900B2 (O'Connell) describes a mobile studio for producing video and audio content. The studio includes a vehicle having a studio chamber enclosure formed by a floor, a ceiling, spaced apart outer walls and spaced apart front and rear walls. The floor provides a stage area. An LED lighting assembly is located in the studio chamber enclosure to provide sufficient illumination for image capture. An image projection apparatus is used to create a virtual image behind a partially transparent screen. A camera is used to capture an image of a person on the stage area, and a communications device is used to transmit the captured image. O'Connell does not address audio projection at an outdoor venue.

WO2014/125364A2 (Verma) relates to a mobile stage carved from a container unit mounted on a truck. The stage has a pair of foldable wings hingedly connected to the top and bottom of the stage along the length of the rear portion of the stage. The stage also has an electric shutter pivotally connected to the top of the stage, a projector and a reflective screen. The system is aimed at theater productions, projection screens for displaying documentary and feature films, and a separate space for displaying virtual images. The mobile stage is limited to outdoor venues accessible by a tractor trailer. Verma does not address audio projection to a larger audience.

There is a need for a mobile entertainment and announcement system capable of being transported to a variety of outdoor venues and capable of projecting audio to a large audience, often spread over a large area at an outdoor venue.

SUMMARY OF THE INVENTION

According to one aspect of the present invention, there is provided a mobile entertainment and announcement system, comprising: a trailer base having a trailer body mounted thereon, at least one pair of wheels operably connected to an underside of the trailer base, and a trailer hitch projecting from a forward end of the trailer base, the trailer base adapted to be transported to a desired venue by connecting the trailer hitch to a vehicle; a telescoping boom supported by at least one of the trailer base and the trailer body, the telescoping boom adapted to move from a transport position to a set-up position and to a broadcast position; at least one broadcast speaker adapted for mounting on the telescoping boom when the telescoping boom is in a set-up position, so that when the telescoping boom is moved from the transport position to the broadcast position, the broadcast speaker is moved to a higher elevation above the trailer base; an audio component housed in the trailer body and connected to the broadcast speaker for transmitting audio content to the broadcast speaker for broadcast; and a power supply for providing power to the at least one broadcast speaker and the at least one audio component, the trailer body adapted to provide protection to at least one of the audio component and the power supply.

BRIEF DESCRIPTION OF THE DRAWINGS

The apparatus of the present invention will be better understood by referring to the following detailed description of preferred embodiments and the drawings referenced therein, in which.

DETAILED DESCRIPTION OF THE INVENTION

The present invention provides a mobile entertainment and announcement system that can be transported to a variety of outdoor venues, such as beaches, golf courses, church grounds, fair grounds, parking lots, parks, and the like. The mobile entertainment and announcement system of the present invention allows audio content to be projected to a wider audience than prior art devices.

Figure 1A:
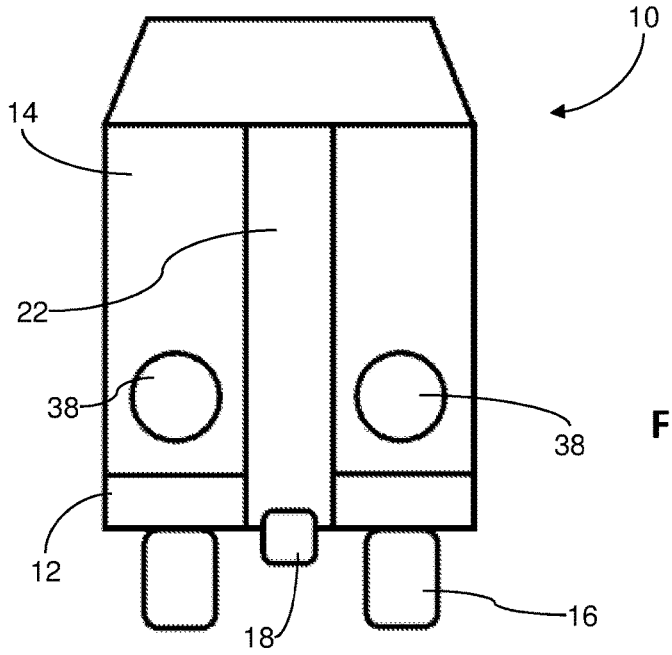
FIG. 1A is a front elevation view of one embodiment of the mobile entertainment and announcement system of the present invention.
Figure 1B:
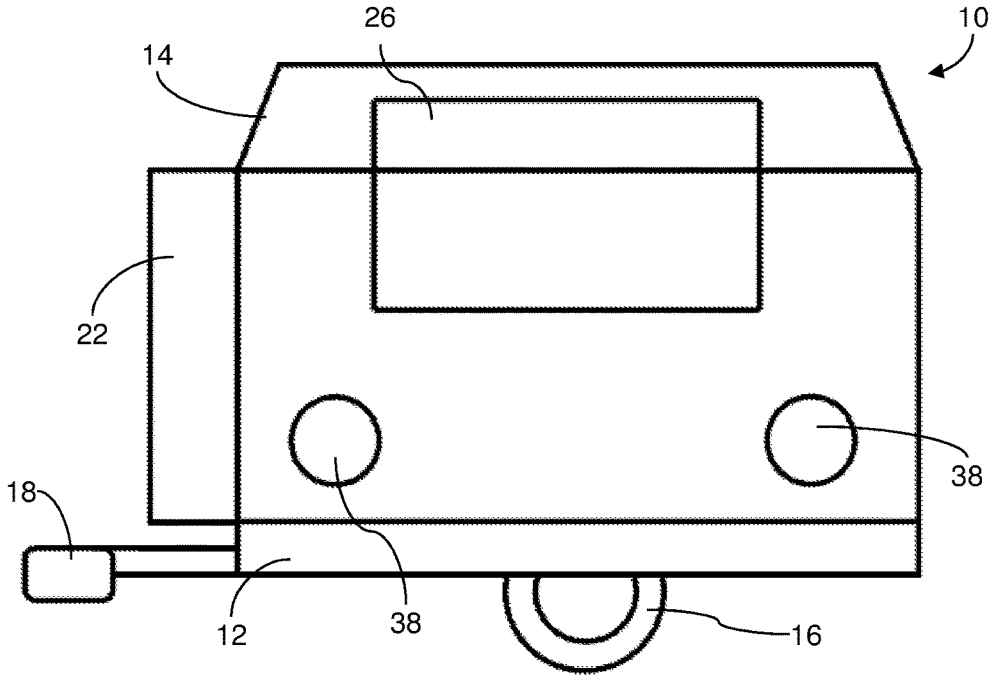
FIG. 1B is a side elevation view of the mobile entertainment and announcement system of FIG. 1A.

Referring now to FIGS. 1A and 1B, a mobile entertainment and announcement system 10 of the present invention has a trailer base 12. The trailer base 12 has a trailer body 14 mounted thereon and at least one pair of wheels 16 operably connected to the trailer base 12. A trailer hitch 18 projects from a forward end of the trailer base 12, allowing the trailer base 12 to be connected to a trailer hitching device on a vehicle for transporting the mobile entertainment and announcement system 10 to a desired venue. Those skilled in the art will understand that a variety of trailer hitches 18 can be used for the mobile entertainment and announcement system 10 of the present invention without departing from the spirit of the present invention.

The trailer base 12 is preferably constructed and equipped to meet local regulations for roadworthy vehicles, including, but not limited to, license plates, signal lights, brake lights, and the like. Suitable vehicles for transporting the mobile entertainment and announcement system 10 of the present invention include, without limitation, pick-up trucks, cars, buses, sport utility vehicles (SUV), utility task vehicles (UTV), also referred to as SxS or side-by-side vehicles, all-terrain vehicles (ATV), and the like.

The mobile entertainment and announcement system 10 of the present invention has a telescoping boom 22 supported by one or both of the trailer base 12 and the trailer body 14. The telescoping boom 22 is shown in FIGS. 1A and 1B in a transport position. The trailer body 14 may include a cover plate or flap (not shown) to cover the top end of the telescoping boom 22 to protect the telescoping boom 22 from weather and/or environmental elements and/or during transport.

Figure 2A:
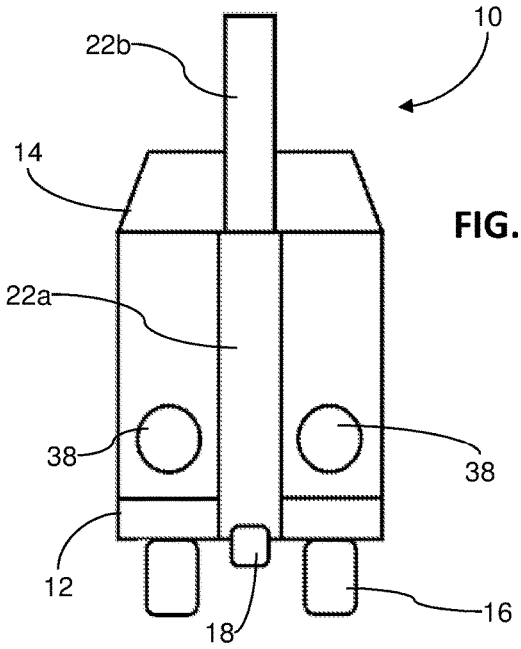
FIG. 2A is a front elevation view of the mobile entertainment and announcement system of FIG. 1A with the telescoping boom in a set-up position.
Figure 2B:
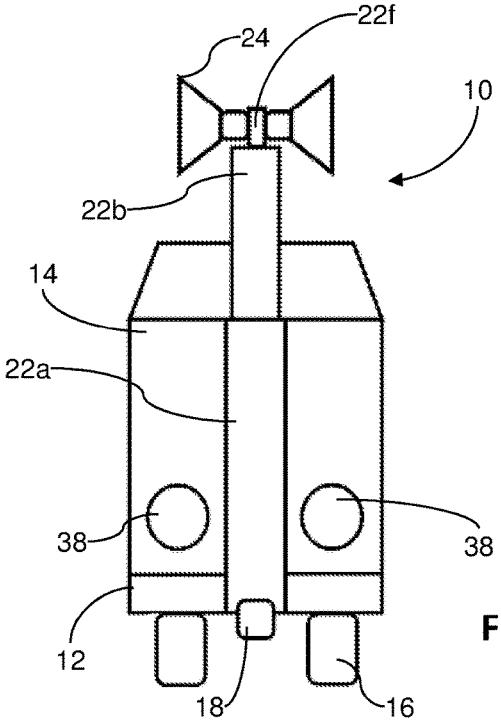
FIG. 2B is a front elevation view of the mobile entertainment and announcement system of FIG. 1A with the telescoping boom in a set-up position and a pair of broadcast speakers mounted to the telescoping boom.
Figure 2C:
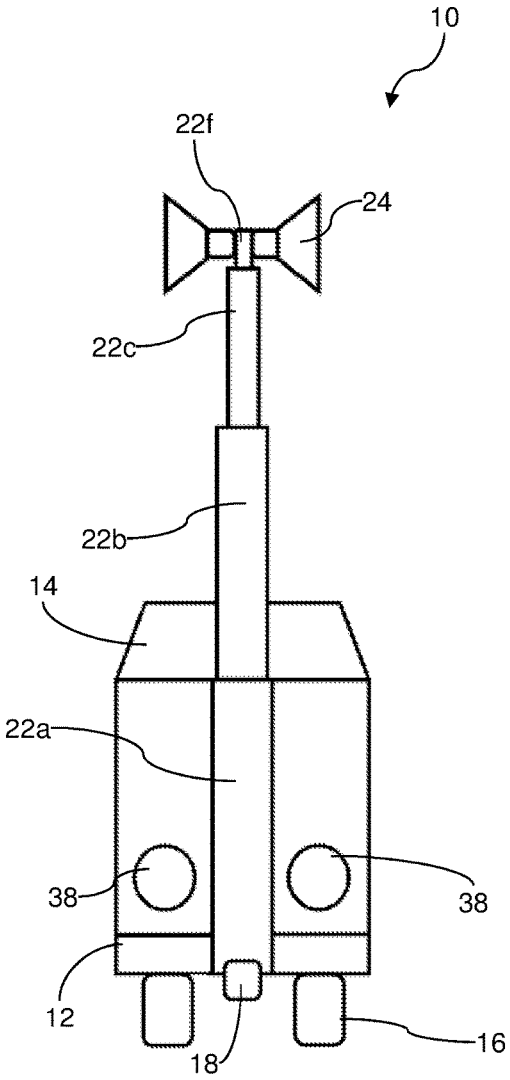
FIG. 2C is a front elevation view of the mobile entertainment and announcement system of FIG. 1A with the telescoping boom in a broadcast position with a pair of broadcast speakers mounted to the telescoping boom.

The telescoping boom 22 has boom sections 22*a*, 22*b*, 22*c* and 22*f*, shown more clearly in FIGS. 2A-2C, to raise broadcast speakers 24 to a desired broadcast height. For example, the telescoping boom 22 may have six boom sections 22*a*, 22*b*, 22*c*, through to 22*f* to raise the broadcast speakers 24 to a height of 25 feet, for example. It will be understood by those skilled in the art that fewer or more sections of telescoping boom 22 may be used without departing from the spirit of the present invention. The telescoping boom 22 may be raised and lowered hydraulically, electrically, mechanically and combinations thereof.

FIG. 2A shows the mobile entertainment and announcement system 10 of the present invention with one section of the boom 22*b* retracted from the base telescoping boom section 22*a*. This height may be particularly advantageous for a set-up position, where at least one broadcast speaker 24 is mounted on the telescoping boom section 22*f*, as shown in FIG. 2B with two broadcast speakers 24. Preferably, there are four broadcast speakers 24 mounted to the telescoping boom 22. The broadcast speakers may be mounted at the same height or different heights on the telescoping boom 22. FIG. 2C illustrates the telescoping boom 22 raised to one embodiment of a broadcast position, with a third section of telescoping boom 22*c* raised.

Figure 3:
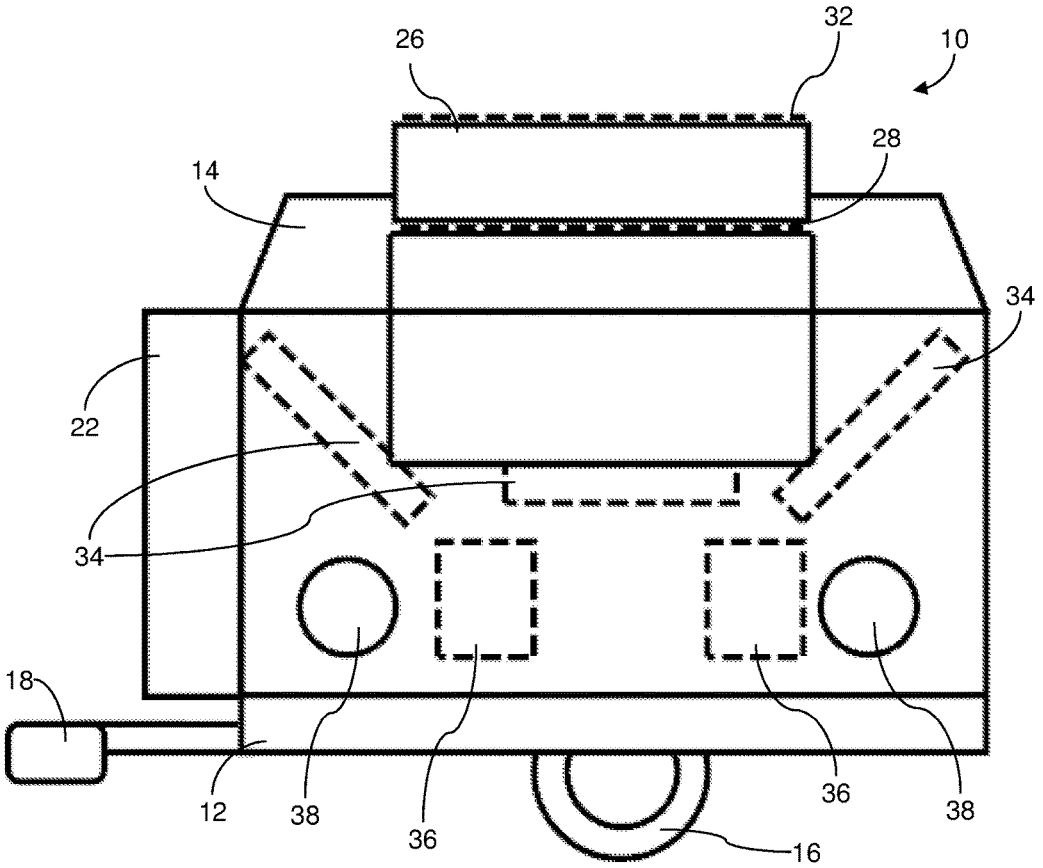
FIG. 3 is a side elevation of a mobile entertainment and announcement system of the present invention, showing one embodiment of an access door to a trailer body and audio components and power supply housed in the trailer body.

An audio component for transmitting audio content through the broadcast speakers 24 is housed in the trailer body 14 and accessed through access door 26, shown in FIG. 1B. As shown in FIG. 3, the access door 26 is hingedly connected to the trailer body 14 with hinge 28 and, advantageously, has an intermediate hinge 32 to fold a portion of the access door 26 back on itself. Alternatively or in combination, a piston-type lift (not shown) may be used to open and close the access door 26. The access door 26 may be also be provided without the intermediate hinge 32, which may advantageously shield an operator and/or components in the trailer body 14 from weather elements. It will be understood by those skilled in the art that different configurations for the access door 26 are possible without departing from the spirit of the present invention.

In the embodiment shown in FIG. 3, three amplifiers 34 provide audio content to be transmitted through broadcast speakers 24. The amplifiers 34 are connected to the broadcast speakers 24 in a manner known to those skilled in the art. Other audio components may be used in place of or in conjunction with one or more amplifiers 34. Such audio components include, without limitation, BLUETOOTH wireless technology devices for exchanging data over short distances, radios, DVD players, televisions, satellite receivers, DVR recorders, microphones, and combinations thereof In addition to the audio component, one or more video components (not shown) may be provided to broadcast video content.

In a further embodiment, one or more auxiliary entertainment modules may be added to the mobile entertainment and announcement system of the present invention. Such auxiliary entertainment module may include, without limitation, LED lights, flood lights, strobe lights, black lights, smoke machines, and combinations thereof.

The mobile entertainment and announcement system 10 of the present invention also has a power supply. In the embodiment shown in FIG. 3, the power supply is a pair of batteries 36 housed in the trailer body 14. Other power supplies for providing power to the audio components and/or broadcast speakers include energy storage devices, such as batteries and fuel cells, electromechanical systems, such as generators and alternators, and solar power converters.

Combinations of these power supplies may also be used. The placement of the power supply within, on or adjacent to the trailer body 14 will depend on the type of power supply used.

The trailer body 14 also acts as storage for the broadcast speakers 24 during transport. The mobile entertainment and announcement system 10 of the present invention is preferably provided with supplemental speakers 38 housed in the trailer body 14. More preferably, the supplemental speakers 38 are provided on the front, rear and side faces of the trailer body 14 for further enhancing the audio content being broadcast at the outdoor venue.

The mobile entertainment and announcement system 10 of the present invention may be further provided with promotional indicia, including, without limitation, banners, logos, flags, static advertising displays, electronic advertising displays and combinations thereof While preferred embodiments of the present disclosure have been described, it should be understood that various changes, adaptations and modifications can be made therein without departing from the spirit of the invention(s) as claimed below.

I claim:

1. A mobile entertainment and announcement system, comprising:

a trailer base having a trailer body mounted thereon, at least one pair of wheels operably connected to an underside of the trailer base, and a trailer hitch projecting from a forward end of the trailer base, the trailer base adapted to be transported to a desired venue by connecting the trailer hitch to a vehicle, wherein the vehicle is selected from the group consisting of pick-up trucks, cars, buses, sport utility vehicles, utility task vehicles, all-terrain vehicles and combinations thereof;

a telescoping boom supported by at least one of the trailer base and the trailer body, the telescoping boom adapted to move from a transport position to a set-up position and to a broadcast position;

at least one broadcast speaker adapted for mounting on the telescoping boom when the telescoping boom is in a set-up position, so that when the telescoping boom is moved from the transport position to the broadcast position, the broadcast speaker is moved to a higher elevation above the trailer base;

an audio component housed in the trailer body and connected to the broadcast speaker for transmitting audio content to the broadcast speaker for broadcast; and a power supply for providing power to the at least one broadcast speaker and the at least one audio component, the trailer body adapted to provide protection to at least one of the audio component and the power supply.

2. The mobile entertainment and announcement system according to claim 1, wherein the telescoping boom is moved from a transport position to a set-up position by an actuator selected from the group consisting of hydraulic actuators, electrical actuators, mechanical lifts, and combinations thereof.

3. The mobile entertainment and announcement system according to claim 1, wherein the audio component is selected from the group consisting of BLUETOOTH wireless technology devices for exchanging data over short distances, radios, DVD players, televisions, satellite receivers, DVR recorders, amplifiers, microphones, and combinations thereof.

4. The mobile entertainment and announcement system according to claim 1, further comprising at least one supplemental speaker housed in a wall of the trailer body.

5. The mobile entertainment and announcement system according to claim 1, further comprising a video component.

6. The mobile entertainment and announcement system according to claim 1, further comprising an auxiliary entertainment module.

7. The mobile entertainment and announcement system according to claim 6, wherein the auxiliary entertainment module is selected from the group consisting of LED lights, flood lights, strobe lights, black lights, smoke machines, and combinations thereof.

8. The mobile entertainment and announcement system according to claim 1, further comprising promotional indicia.

9. The mobile entertainment and announcement system according to claim 8, wherein the promotional indicia is selected from the group consisting of banners, logos, flags, static advertising displays, electronic advertising displays and combinations thereof.

10. The mobile entertainment and announcement system according to claim 1, wherein the power supply is selected from the group consisting of energy storage devices, electromechanical systems, solar power converters, and combinations thereof.

11. The mobile entertainment and announcement system according to claim 10, wherein the energy storage device is selected from the group consisting of batteries, fuel cells, and combinations thereof.

12. The mobile entertainment and announcement system according to claim 10, wherein the electromechanical system is selected from the group consisting of generators, alternators, and combinations thereof.

* * * * *